US009203178B2

(12) United States Patent
Sakakura

(10) Patent No.: US 9,203,178 B2
(45) Date of Patent: Dec. 1, 2015

(54) SEAL COVER FOR IN-VEHICLE ELECTRIC DEVICE

(75) Inventor: Kouji Sakakura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 457 days.

(21) Appl. No.: 13/456,576

(22) Filed: Apr. 26, 2012

(65) Prior Publication Data

US 2012/0285097 A1 Nov. 15, 2012

(30) Foreign Application Priority Data

May 10, 2011 (JP) ..... 2011-105302

(51) Int. Cl.

| | |
|---|---|
| ***H01R 13/46*** | (2006.01) |
| ***H01R 13/627*** | (2006.01) |
| ***H01R 31/08*** | (2006.01) |
| ***H01R 13/52*** | (2006.01) |
| *H01R 13/512* | (2006.01) |
| *H01R 43/18* | (2006.01) |

(52) U.S. Cl.

CPC ..... *H01R 13/5213* (2013.01); *H01R 13/512* (2013.01); *H01R 43/18* (2013.01); *H01R 2201/26* (2013.01)

(58) Field of Classification Search

CPC ..... H01R 13/703; H01R 13/7031; H01R 13/7032; H01R 13/7033; H01R 13/7034; H01R 43/22; H01R 13/512; H01R 13/5213; H05K 5/0069

USPC ..... 174/520, 521, 527, 50.5; 439/149, 188, 439/271, 278, 281, 362, 364, 509, 548, 559, 439/587, 607.55, 607.56, 607.57, 607.58, 439/911

See application file for complete search history.

(56) References Cited

U.S. PATENT DOCUMENTS

| | | | | | |
|---|---|---|---|---|---|
| 4,684,190 | A | * | 8/1987 | Clark et al. | 439/587 |
| 4,808,115 | A | * | 2/1989 | Norton et al. | 439/79 |
| 5,071,369 | A | * | 12/1991 | Denlinger et al. | 439/595 |
| 5,078,626 | A | * | 1/1992 | Matsuoka et al. | 439/892 |
| 5,165,834 | A | * | 11/1992 | Takenouchi et al. | 411/542 |
| 5,538,445 | A | * | 7/1996 | Grzybowski et al. | 439/752 |
| 5,803,763 | A | * | 9/1998 | Grant | 439/364 |
| 5,820,401 | A | | 10/1998 | Hasz | |
| 5,997,328 | A | * | 12/1999 | Kodama et al. | 439/247 |
| 6,132,230 | A | * | 10/2000 | Shinozaki et al. | 439/281 |
| 2009/0233478 | A1 | * | 9/2009 | Cross et al. | 439/488 |
| 2010/0255728 | A1 | | 10/2010 | Matsuoka et al. | |
| 2011/0100704 | A1 | * | 5/2011 | Iida et al. | 174/520 |

* cited by examiner

*Primary Examiner* — Chau N Nguyen
*Assistant Examiner* — Roshn Varghese
(74) *Attorney, Agent, or Firm* — Gerald E. Hespos; Michael J. Porco; Matthew T. Hespos

(57) ABSTRACT

A seal cover (S) for closing work openings provided in a case includes a cover main body (10) to cover openings of the case. Seal ring holders (20A, 20B) are arranged on the underside of the cover main body (10) and fit into the openings. Seal rings (25) are on the outer peripheral surfaces of the seal ring holders (20A, 20B) and closely contact inner peripheral surfaces of the openings. Insertion holes (13) penetrate between top and underside surfaces of the cover main body (10). Shafts (26) project from surfaces of the seal ring holders (20A, 20B) facing the underside surface of the cover main body (10) and are inserted into the insertion holes (13) with a clearance. Retainers (16) for retaining the shafts (26) are provided at the projecting ends of the shafts (26) and are engaged with the edges of the insertion holes (13).

7 Claims, 13 Drawing Sheets

SEAL COVER FOR IN-VEHICLE ELECTRIC DEVICE

BACKGROUND OF THE INVENTION

1. Field of the Invention

The invention relates to a seal cover to be removably attached to close an opening such as a work opening provided in a case of an in-vehicle electric device.

2. Description of the Related Art

An electric vehicle is likely to have a device mounted in a case. The case typically has an opening for accessing internal connectors, and a seal cover or service cover is attached to the opening. U.S. Patent Application Publication No. 2010/0255728 discloses a conventional seal cover with a main body capable of covering an opening. A fitting on the underside of the main body and can fit into the opening and locking pieces are provided to engage the opening. A seal ring is mounted on the outer peripheral surface of the fitting and closely contacts the inner peripheral surface of the opening to provide sealing when the seal cover is attached to the opening. Thus, water and external matter cannot enter through the opening.

A squeeze amount of the seal ring needs to be uniform over the entire periphery to ensure high quality sealing in the above-described seal cover. To this end, high connection accuracy is required between the fitting portion of the seal cover and the opening. Conventionally, a positioning pin called a knock pin is provided on a seal cover to provide sufficient connection accuracy between a fitting portion and an opening. However, high working accuracy and the like are necessary to provide the knock pin, which leads to a cost increase. More particularly, managing connection accuracy by knock pins has been limited if there are plural openings.

The present invention was completed based on the above situation and an object thereof is to ensure high sealing ability for an opening at low cost.

SUMMARY OF THE INVENTION

The invention relates to a seal cover that is removably attachable to an opening in a case that houses an in-vehicle electric device. The seal cover has a cover main body that can be attached to a surface of the case and that is shaped to cover the opening of the case. At least one seal ring holder is arranged on the underside of the cover main body and can fit into the opening. A seal ring is mounted on the seal ring holder and is held in close contact with the opening. At least one insertion hole penetrates the main body between top and underside surfaces. At least one shaft projects from a surface of the seal ring holder substantially facing the underside surface of the cover main body and is inserted into the insertion hole with a clearance. At least one retaining means is provided at the shaft for retaining the shaft by engaging the cover main body.

The seal ring holder is supported in a floating state with respect to the underside surface of the cover main body and is movable in all directions such as forward, backward and lateral directions. Thus, the seal ring holder can be fit into the opening of the case while being centered as the cover main body is attached to the case. In this way, the seal ring is mounted while being squeezed uniformly over the entire periphery to ensure high sealing for the opening. Further, the floating structure does not require the high working accuracy of a knock pin. Therefore, the seal cover can be produced at low cost.

The retaining means for retaining the shaft preferably is at the projecting end of the shaft and is engaged with the edge of the insertion hole on the top side.

A substantially cylindrical nut projects from the surface of the seal ring holding member facing the underside surface of the cover main body and is insertable into the insertion hole with a clearance. A screw hole extends into the projecting end surface of the nut. A screw particularly is engaged threadedly with the screw hole of the nut.

The retaining means for retaining the shaft by engaging the edge of the insertion hole on the top side of the cover main body preferably is provided on or near a head of the screw.

The retaining means at the head of the screw prevents the seal ring holder from falling down when the nut is inserted into the insertion hole of the cover main body and the screw is screwed into the nut. The seal ring holder is supported in a floating manner due to the clearance between the nut and the insertion hole.

At least one restricting hole is perforated on the underside surface of the cover main body at a position lateral to the insertion hole. At least one projection is formed on the surface of the seal ring holder facing the underside surface of the main body and can fit into the restricting hole with a clearance as the shaft is inserted into the insertion hole.

The insertion hole and the restricting hole support the seal ring holder and prevent the seal ring holder from rotating when the screw is tightened. Additionally, the restricting hole prevents the seal ring from being mounted in a wrong posture.

An interlock connector preferably projects from the seal ring holder and is connectable to a waiting connector of the electric device for setting an electric member of the electric device in a specified electric state. The interlock connector is movable in a direction aligned at an angle, preferably a right angle, to a connecting direction to the waiting connector.

At least one pin preferably is provided on one of the seal ring holder and the main body and at least one restricting hole is provided in the other of the seal ring holder and the cover main body to prevent erroneous mounting of the seal ring holder on the cover main body and a rotational displacement of the seal ring holder with respect to the main body.

A clearance preferably is provided between the pin and the restricting hole and preferably is smaller than the clearance between the shaft and the insertion hole.

These and other objects, features and advantages of the present invention will become more apparent upon reading of the following detailed description of preferred embodiments and accompanying drawings.

DETAILED DESCRIPTION OF THE PREFERRED EMBODIMENTS

A seal cover in accordance with an embodiment of the invention is provided for simultaneously closing two juxtaposed work openings 110 in one surface of a shield case 100 that houses an electric device. Further, an interlock mechanism is provided that sets an electric member (such as a circuit) in a specified electric state, e.g. turns on and off an energizing circuit for the electric device, as this seal cover is attached and removed. Although not shown, a waiting connector accommodating two contact terminals drawn out from the electric member (e.g. the energizing circuit) is mounted on a terminal block in the case.

Figure 1:
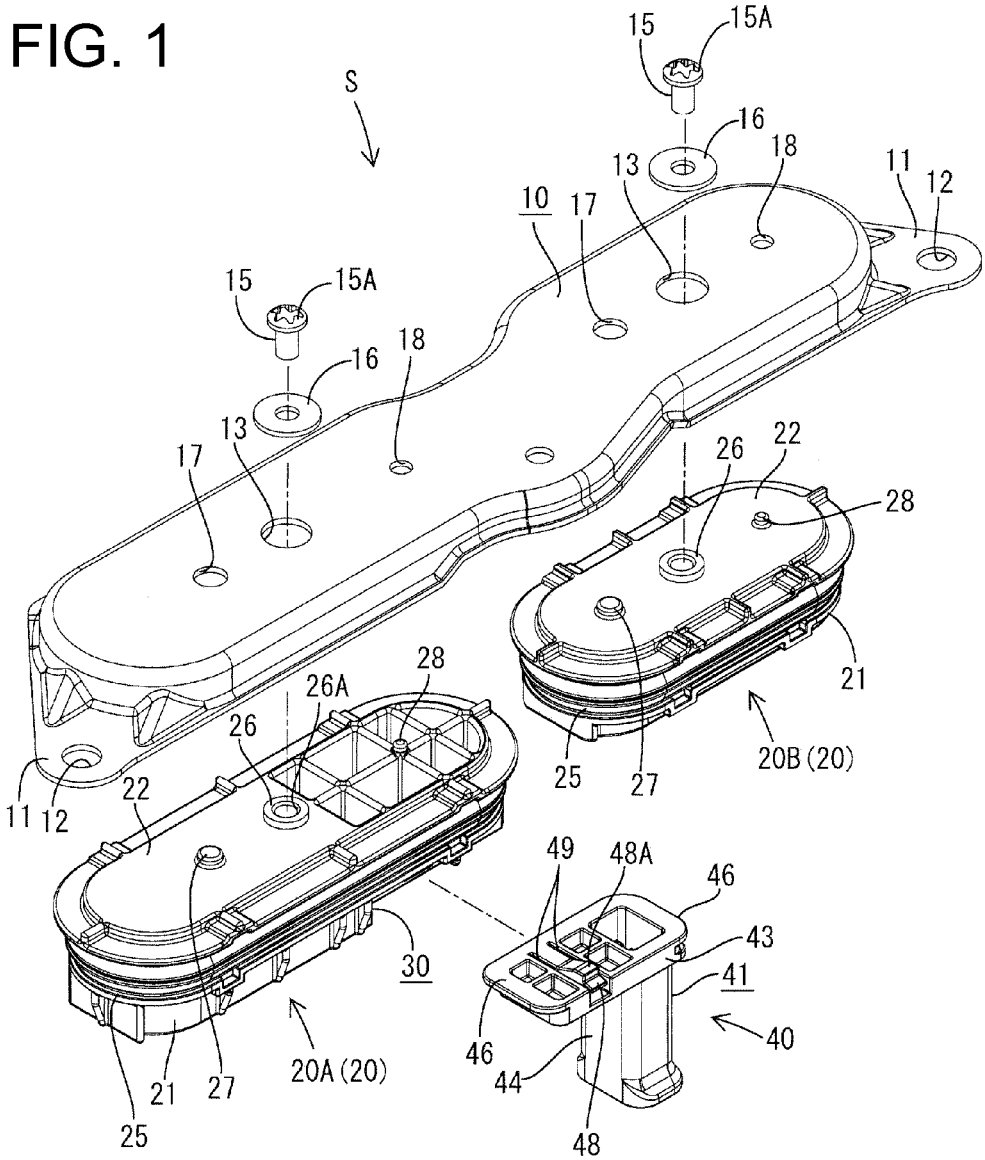
FIG. 1 is an exploded perspective view of a seal cover according to one embodiment of the present invention.

As shown in FIG. 1, the seal cover S includes a cover main body 10, two seal ring holders 20 and an interlock connector 40.

The cover main body 10 is formed by press-working a conductive plate, such as a steel plate, and defines a long narrow substantially elliptical inverted shallow saucer capable of covering the both openings of the case. Specifically, the two seal ring holders 20 are arranged substantially side by side on the underside of the cover main body 10. Mounting plates 11 project from both ends of the opening edge on the underside of the cover main body 10 in a length direction, and each mounting plate 11 has an insertion hole 12 for a bolt.

Figure 2:
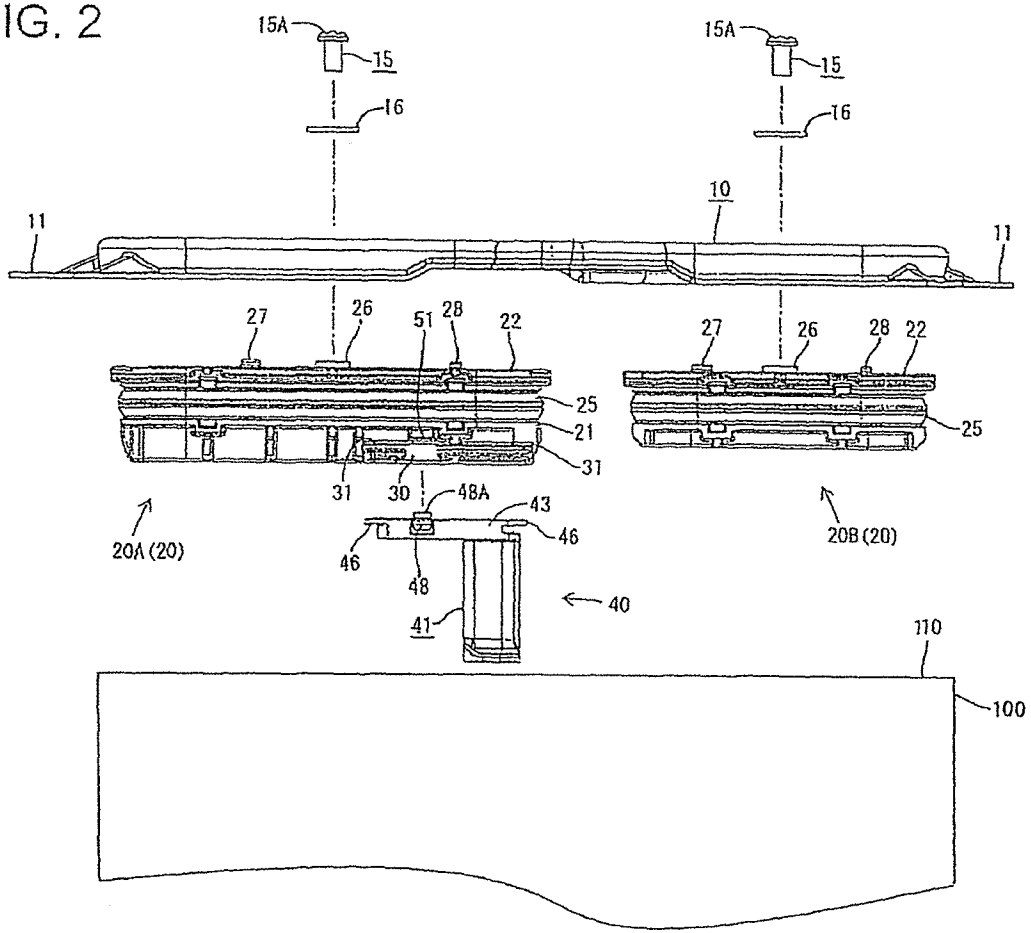
FIG. 2 is an exploded front view of the seal cover of FIG. 1.
Figure 3:
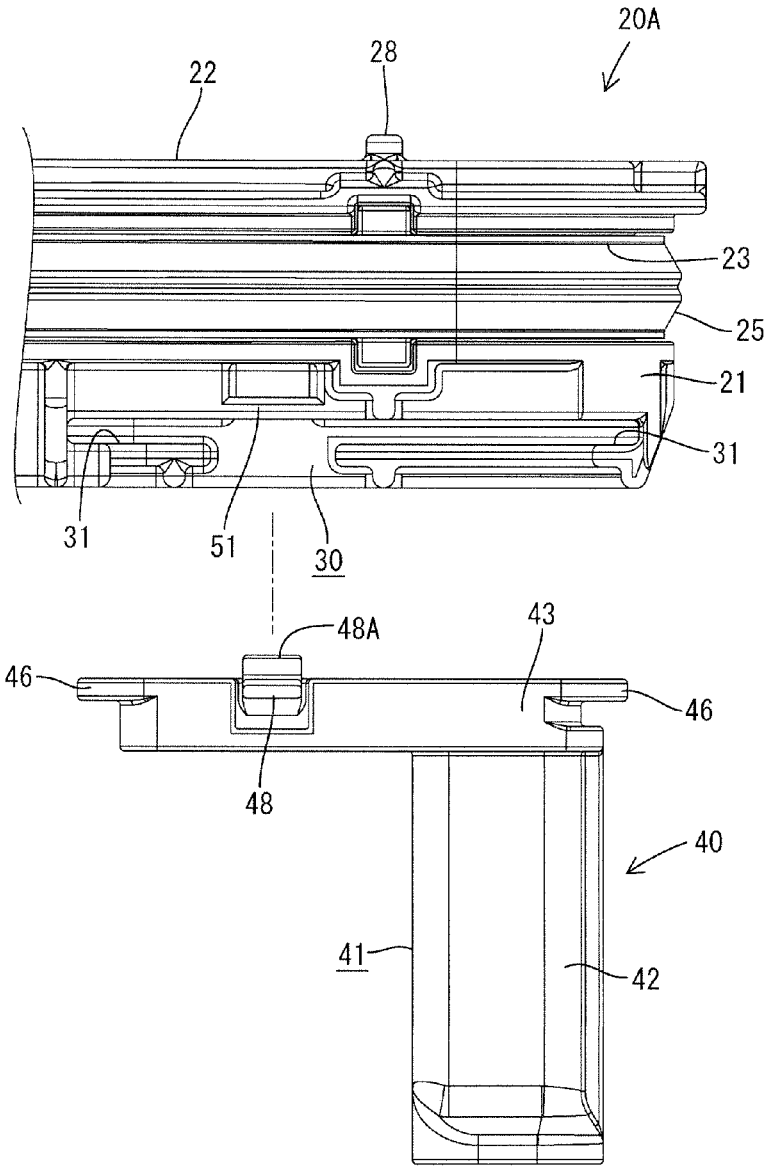
FIG. 3 is a partial enlarged view of FIG. 2.
Figure 4:
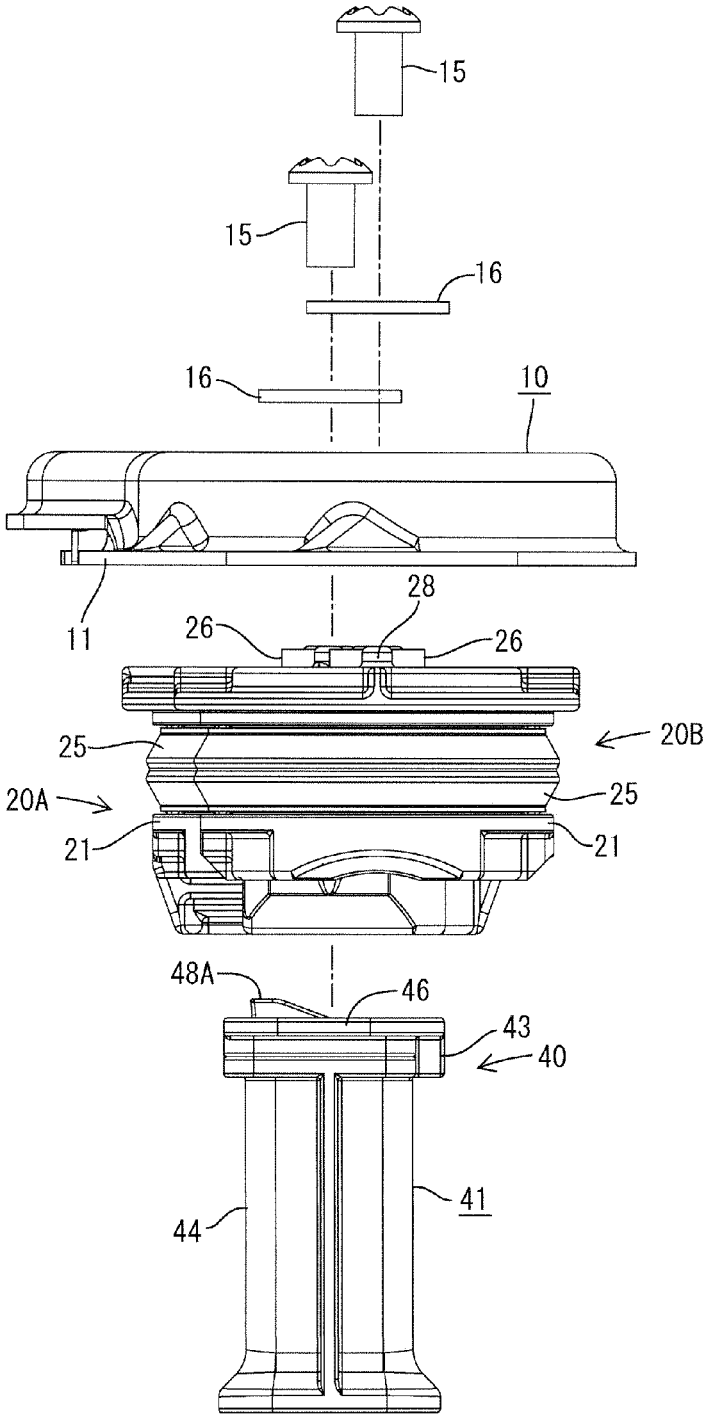
FIG. 4 is an exploded side view of the seal cover.
Figure 5:
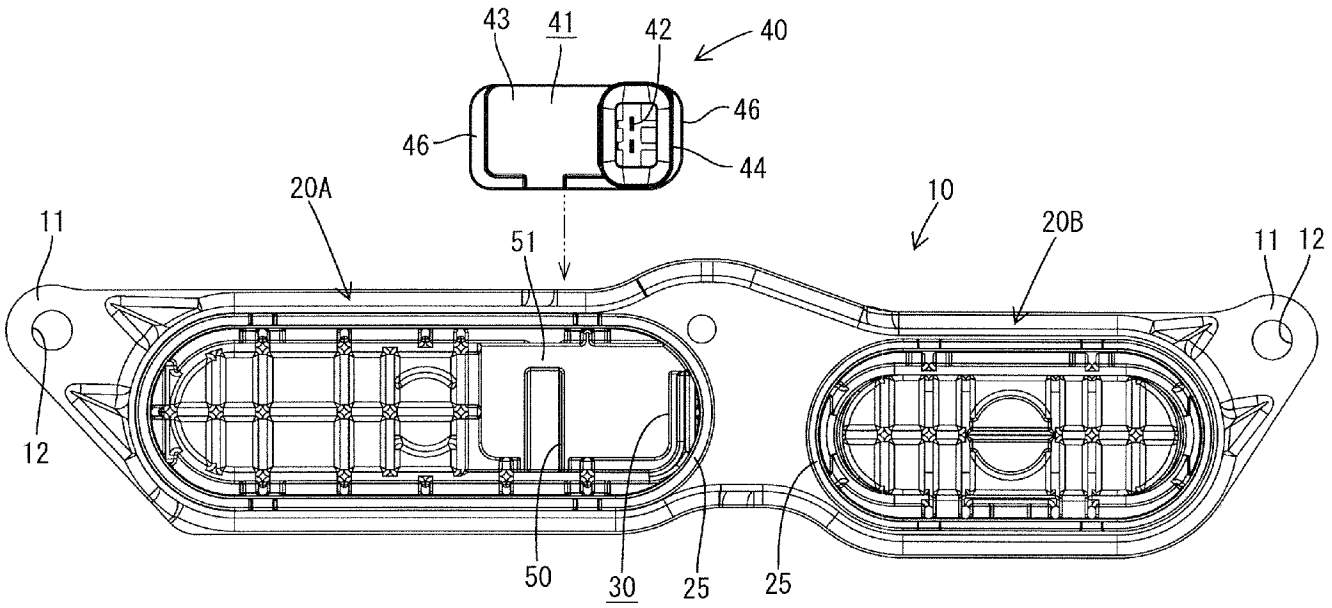
FIG. 5 is a bottom view showing an operation of mounting an interlock connector.
Figure 6:
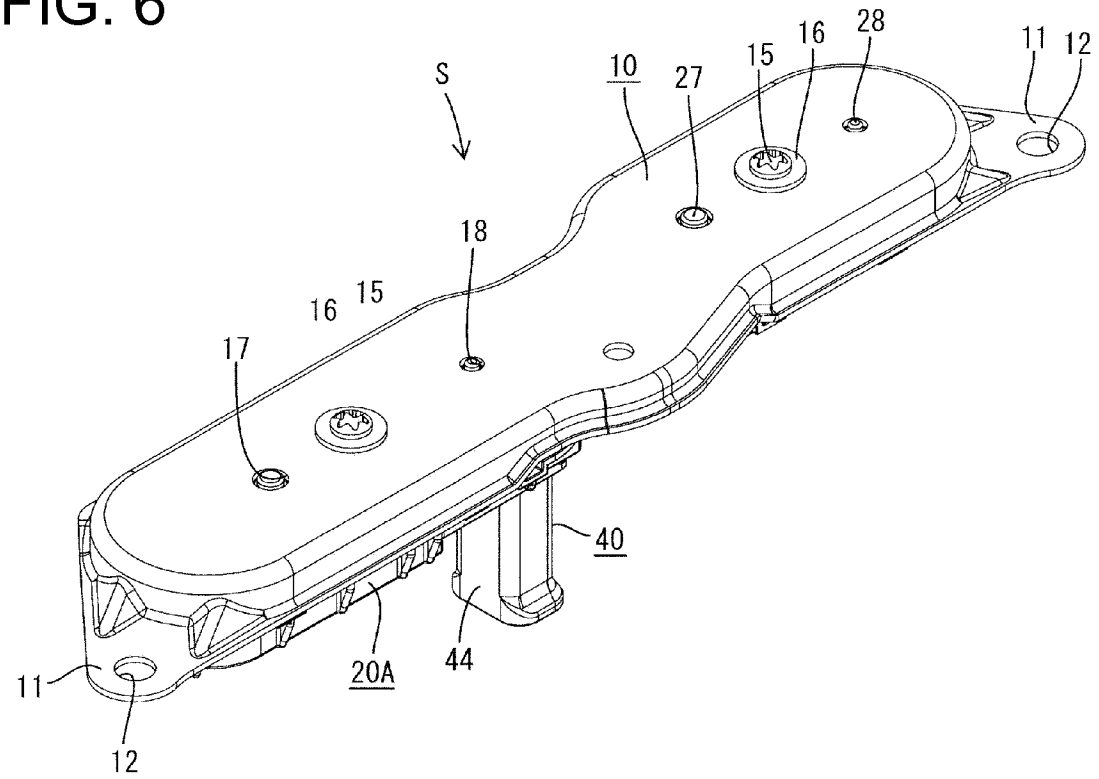
FIG. 6 is a perspective view of the seal cover when an assembling operation is completed.
Figure 7:
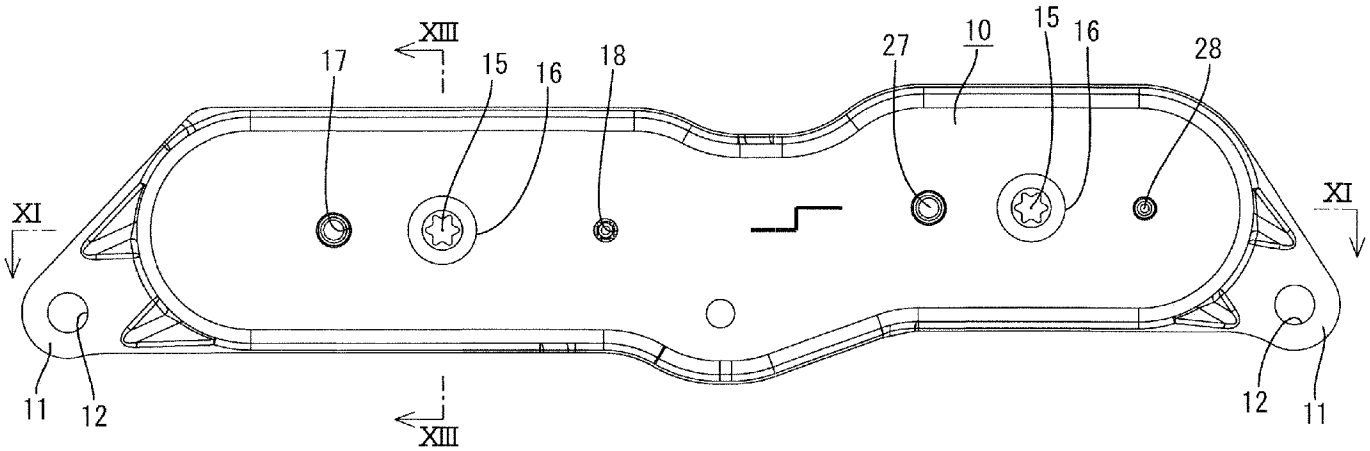
FIG. 7 is a plan view of the seal cover of FIG. 6.

The seal ring holder 20 (hereinafter, merely referred to as the "holder" 20) is made e.g. of synthetic resin and a thick holder main body 21 and a lid plate 22 formed on the main body 21. The holder main body 21 has a substantially elliptical plan view and is configured to fit into the opening of the case. The lid plate 22 is larger than the main body 21 and is configured for covering the edge of the opening. The two openings of the case differ in size. Thus, the holders 20 include a first holder 20A with a relatively long major axis and a second holder 20B with a relatively short major axis. Further, as shown in FIG. 2, the thickness of the holder main body 21 of the first holder 20A is larger. Note that the two holders 20A, 20B are referred to as the holders 20 when a description common to both is given. It should be understood that the main body 21 may have a differing number of holders 21 such as only one holder or three or more holders.

Figure 11:
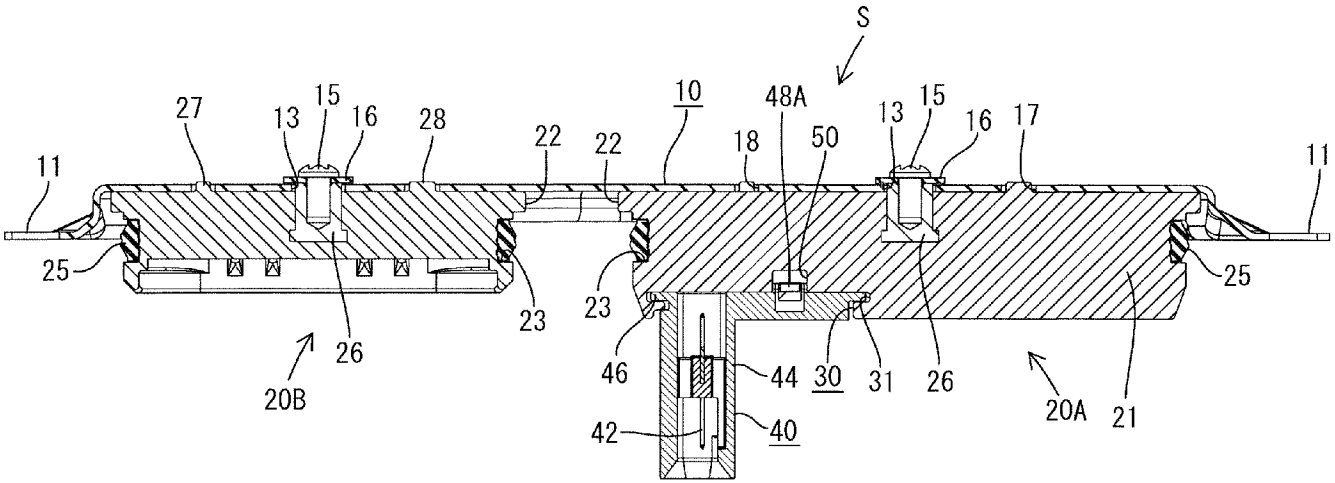
FIG. 11 is a section along XI-XI of FIG. 7.

As shown in FIG. 11, a seal mounting groove 23 is formed around the entire outer peripheral surface of the main body 21 of each holder 20 near the upper end and an annular seal ring 25 is mounted in the seal mounting groove 23. Outer dimensions of the seal ring 25 are slightly larger than inner dimensions of the corresponding opening.

The two holders 20A, 20B are arranged substantially side by side on the underside of the cover main body 10 and are supported to float or displace along or with respect to the underside surface of the cover main body 10.

A substantially cylindrical nut 26 projects at the center of the lid plate 22 of the holder 20. The nut 26 is embedded by insert molding so that an upper end portion projects a specified length from the upper surface of the lid plate 22. The projecting length of the nut 26 is slightly longer than the thickness of the cover main body 10.

Figure 12:
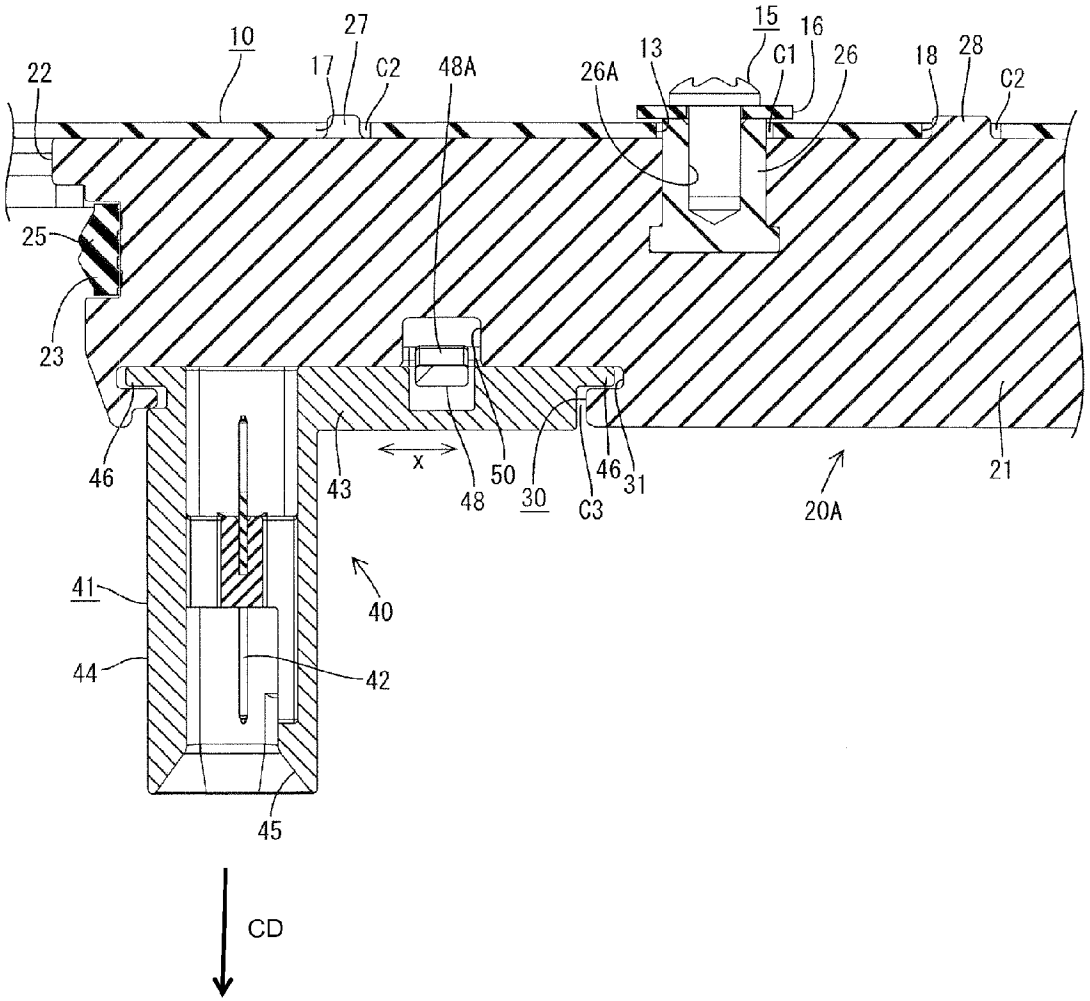
FIG. 12 is a partial enlarged view of FIG. 11.
Figure 13:
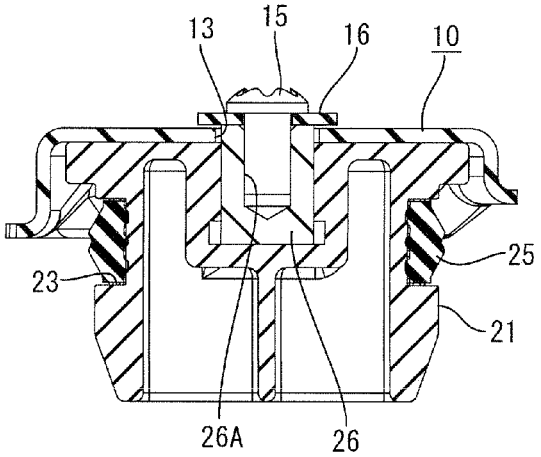
FIG. 13 is a section along XIII-XIII of FIG. 7.

On the other hand, substantially circular insertion holes 13 penetrate between the top and underside surfaces in arrangement areas of the cover main body 10 for the holders 20 and the upper end of the nut 26 projecting from the upper surface of the holder 20 can be inserted into the respective insertion hole 13 with a clearance C1 (see FIG. 12). A screw 15 is engaged threadedly with the screw hole 26A of the nut 26, and a washer 16 larger than the insertion hole 13 is disposed below the head 15A of the screw 15.

Two pins 27, 28 project from the upper surface of the lid plate 22 of each holder 20 at opposite sides of the nut 26 in the length direction. Diameters of the respective pins 27, 28 and/or distances from the nut 26 differ. Projecting heights of the pins 27, 28 are slightly higher than a projecting height of the nut 26.

Restricting holes 17, 18 are formed in the arrangement areas of the cover main body 10 for each holder 20 and penetrate between the top and underside surfaces at the opposite sides of the insertion hole 13. The restricting holes 17, 18 can receive the respective pins 27, 28 projecting from the upper surface of the holder 20 with a clearance C2 (see FIG. 12). The clearances C2 between the pins 27, 28 and the corresponding restricting holes 17, 18 are smaller than the clearance C1 between the nut 26 and the insertion hole 13.

The interlock connector 40 forming an interlock mechanism together with the waiting connector provided in the case is mounted to the first holding member 20A to be able to float or displace with respect to the holder 20.

As also shown in FIG. 12, the interlock connector 40 has a housing 41 made of synthetic resin. The housing 41 accommodates a shorting terminal 42 for connecting the two contact terminals in the waiting connector. More specifically, the housing 41 includes a base 43 and a connector portion 44. The base 43 is substantially rectangular in a plan view. The connector portion 44 is a substantially rectangular tube that hangs down from one longitudinal end of the base 43. The shorting terminal 42 is accommodated in the connector portion 44. A guiding surface 45 is formed on the inner peripheral surface of a lower end of the connector portion 44 and is widened toward the opening edge.

The interlock connector 40 is inserted into an insertion groove 30 in the outer peripheral surface of the first holder 20A and is supported so that the base 43 of the housing 41 can float.

More specifically, slide plates 46 are formed on both shorter side edges of the base 43 of the housing 41 to be flush with the upper surface. Further, a resilient locking piece 48 is provided in an area of the base 30 at a side distant from the connector portion 44. The resilient locking piece 48 is cantilevered from a back side toward a front side in an inserting direction of the base 43 by forming slits 49 at opposite sides of the resilient locking piece 48. A locking projection 48A is formed near an extending end of the resilient locking piece 48, and this extending end is resiliently displaceable downward.

Figure 8:
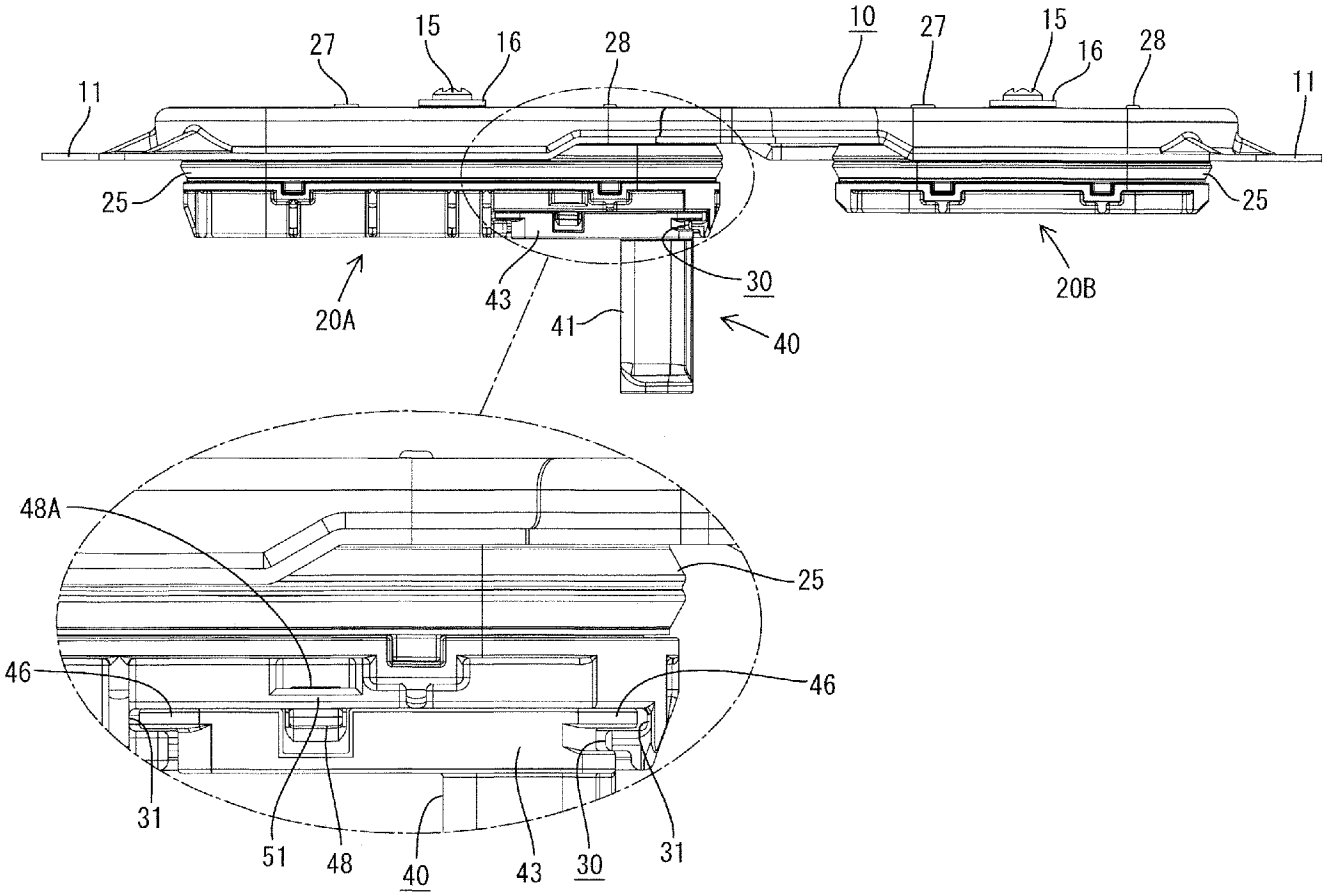
FIG. 8 is a front view of the seal cover of FIG. 6.
Figure 9:
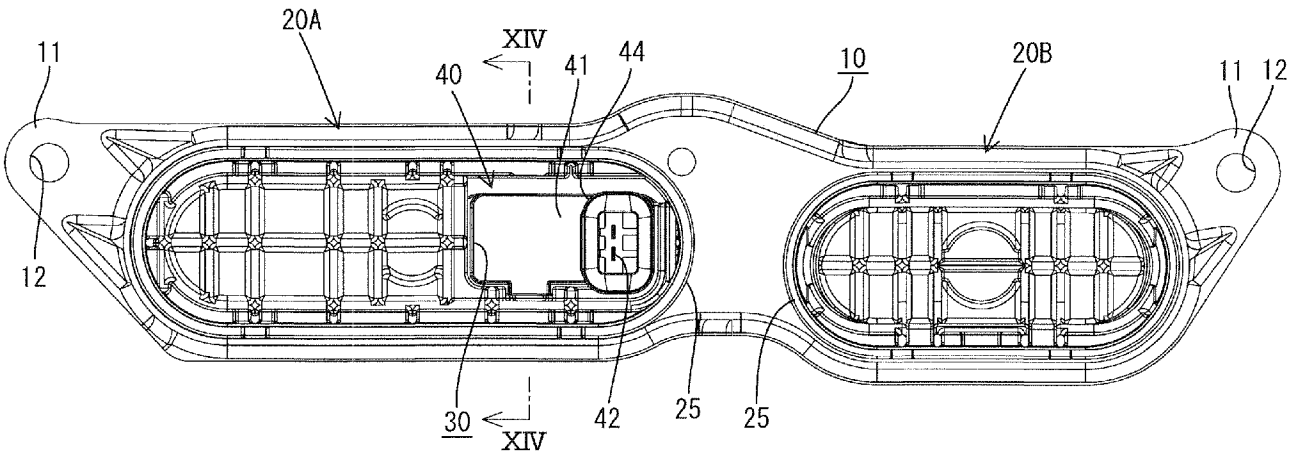
FIG. 9 is a bottom view of the seal cover of FIG. 6.
Figure 10:
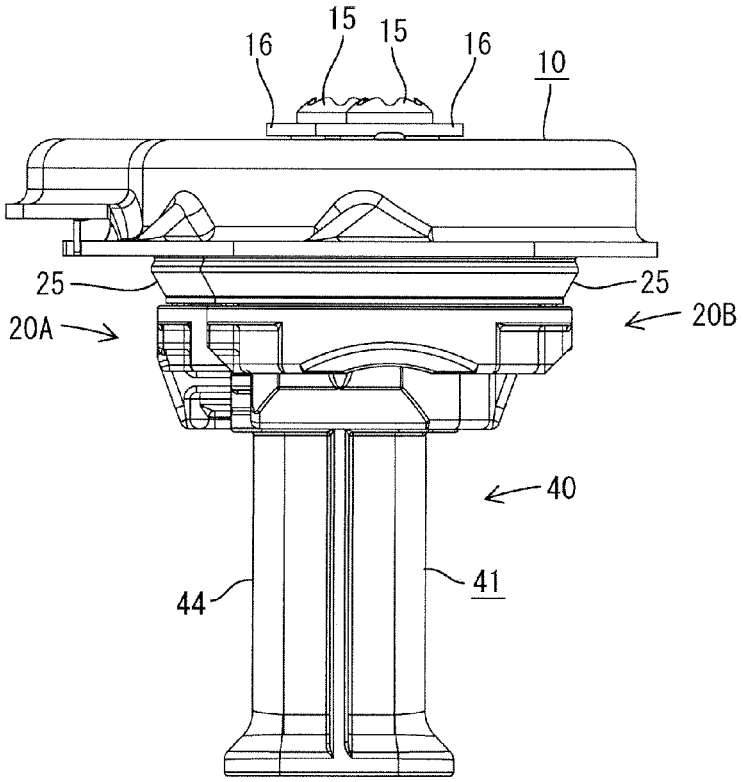
FIG. 10 is a side view of the seal cover of FIG. 6.

As also shown in FIG. 8, the insertion groove 30 is open in the lower surface and the outer peripheral surface on the front side and is closed on the back side by a back surface in a right area of the main body 21 of the first holder 20A when viewed from the front and is lower than the seal mounting groove 23.

As shown in FIG. 12, the insertion groove 30 is wider than the width of the base 43 of the housing 41 by a specified dimension and guide grooves 31 are formed at positions in the insertion groove 30 near the ceiling surface for receiving left and right slide plates 46 projecting from the left and right side surfaces of the base 43. The width of the guide grooves 31 exceeds a distance between the outer edges of the left and right plates 46 by the same predetermined dimension described above.

An escaping groove 50 extends back at a position of the ceiling surface of the insertion groove 30 corresponding to the insertion position of the resilient locking piece 48 while leaving an engaging portion 51 on a front edge for engaging the locking projection 48A of the resilient locking piece 48. The escaping groove 50 is wider than the locking projection 48A by the same predetermined dimension described above. More particularly, specified clearances C3 for permitting the base 43 to move laterally in the insertion groove 30, as shown by arrows x of FIG. 12, are provided between the base 43 (including the slide plates 46) of the housing 41 and the insertion groove 30 (including the guide grooves 31) and between the locking projection 48A of the resilient locking piece 48 and the escaping groove 50.

Figure 14:
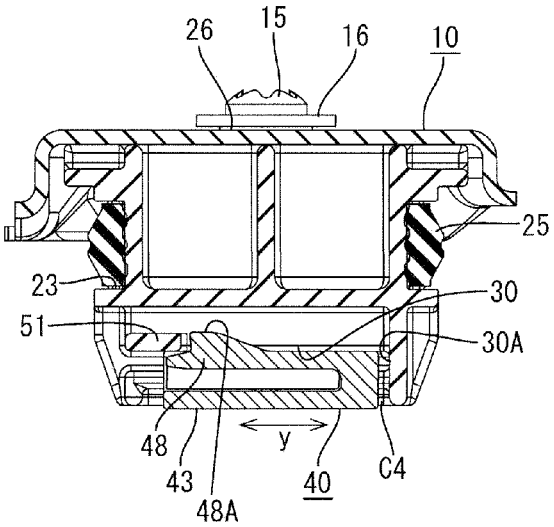
FIG. 14 is a section along XIV-XIV of FIG. 9.

Further, the base 43 of the housing 41 is inserted into the insertion groove 30 from the front while both slide plates 46 are inserted into the guide grooves 31, and pushed while resiliently displacing the resilient locking piece 48 in an intermediate point of an inserting operation. The locking projection 48A passes the engaging portion 51 when the base 43 is pushed to a specified depth. As a result, the locking projection 48A engages the engaging portion 51 to retain the base 43 as shown in FIG. 14 while the resilient locking piece 48 is making a returning movement. At this time, a specified clearance is formed between the rear surface of the base 43 and a back surface 30A of the insertion groove 30. In other words, a specified clearance C4 is provided to permit the base 43 to move in forward and backward directions, as shown by arrows y of FIG. 14, until the base 43 of the housing 41 contacts the back surface 30 and/or the locking projection 48A contacts the engaging portion 51.

The seal cover S is assembled by mounting the seal rings 25 into the seal mounting grooves 23 of the first and second holders 20A, 20B. Subsequently, the interlock connector 40 is held in the insertion groove 30 of the first holder 20A. More particularly, the base 43 of the housing 41 is inserted into the insertion groove 30 with the resilient locking piece 48 facing forward, and the interlock connector 40 is supported in a state to be able to float in forward and backward directions y and lateral direction x when the resilient locking piece 48 is engaged with the engaging portion 51 to retain the base 43.

The first and second holders 20A, 20B then are mounted in the corresponding areas on the underside surface of the cover main body 10. For example, the first holder 20A is mounted on the underside surface in a lateral (e.g. left) area of the cover main body 10 when viewed from front, and brought into contact with the underside surface while the pins 27, 28 at opposite sides of the nut 26 are inserted into the restricting holes 17, 18 and the nut 26 is inserted into the insertion hole 13. At this time, if the first holder 20A is in a reversed orientation, the respective pins 27, 28 do not match the restricting holes 17, 18, thereby restricting the mounting, i.e. preventing erroneous mounting. In this case, the first holder 20A is set in a proper posture and mounted again.

The washer 16 is placed on the upper surface of the nut 26 and the screw 15 is screwed into the screw hole 26A of the nut 26 when the properly oriented first holder 20A contacts the underside surface of the cover main body 10. At this time, the pins 27, 28 on the upper surface of the first holder 20A are in the corresponding restricting holes 17, 18 of the cover main body 10 and prevent the first holder 20A from rotating as the screw 15 is tightened. Therefore, the screw 15 is screwed efficiently.

The projecting length of the nut 26 exceeds the thickness of the cover main body 10. Thus, the washer 16 is fixed to the upper surface of the nut 26 and a clearance is formed between the washer 16 and the cover main body 10 in an axial direction of the nut 26, as shown in FIG. 12, when the screwing of the screw 15 is completed. Thus, the first holder 20A is prevented from falling down from the underside surface of the cover main body 10 by the contact of the washer 16 with the edge of the insertion hole 13 and, on the other hand, is mounted to be slightly movable along the axial direction of the nut 26 at the underside of the cover main body 10.

The clearances C1, C2 are provided between the nut 26 and the insertion hole 13 and between the pins 27, 28 and the restricting holes 17, 18. Thus, the first holder 20A is supported in a floating state and can move with respect to the cover main body 10 in all directions. The clearances C2 between the pins 27, 28 and the restricting holes 17, 18 are smaller than the clearance C1 between the nut 26 and the insertion hole 13. Thus, movements of the first holder 20A are prevented by the contact of the pins 27, 28 with the inner edges of the restricting holes 17, 18. The contact of a resin member with a metal prevents production of metal powder that would result from collision of metals.

The second holder 20B is to be fixed and mounted by the screw 15 in a lateral area of the underside surface of the cover main body 10 in a procedure similar to that described above and also is supported in a floating state to be movable in all directions.

The assembled seal cover S is attached to cover both openings of the shield case. More particularly, the seal cover S is set in a posture conforming to the juxtaposition of the openings and the first and second holders 20A, 20B are fit respectively into the corresponding openings. Accordingly, the interlock connector 40 hanging down from the lower surface of the first holder 20A is inserted deeply into the case to face the waiting connector provided on the terminal block from above.

The cover main body 10 then is pressed toward the upper surface of the seal cover. As a result, the first and second holders 20A, 20B are pushed into the corresponding openings while the seal rings 25 thereof are squeezed in a radial direction. The first and second holders 20A, 20B are supported to float in all directions, and hence can be fit while being centered with respect to the corresponding openings. In this way, the first and second holders 20A, 20B are fit in close contact with the inner peripheral surfaces of the corresponding openings while the seal rings 25 are squeezed substantially uniformly over the entire periphery.

Simultaneously, the mating waiting connector is fit into the connector portion 44 formed in the housing 41 of the interlock connector 40 from the guiding surface 45 side. The housing 41 is supported in the insertion groove 30 of the first holder 20A in a floating state to be movable in forward and backward directions y and lateral directions x. Thus, the connector portion 44 of the housing 41 is centered while being moved in forward and backward directions y and lateral direction x and is connected smoothly to the mating waiting connector as the waiting connector is engaged with the guiding surface 45. As a result, the shorting terminal 42 of the interlock connector 40 connects the pair of contact terminals of the waiting connector.

Finally, bolts are inserted into the insertion holes 12 of the mounting plates 11 on both ends of the cover main body 10 and screwed into bolt holes of the shield case. Thus, the seal cover is fixed to the upper surface of the case. In this state, the openings are closed by the holders 20A, 20B while being sealed uniformly over the entire periphery, and the energizing circuit inside is set in an energized state.

The bolts can be removed and the seal cover S can be pulled up to access the openings. Thus, the connector portion 44 of the interlock connector 40 is separated from the waiting connector so that the contact terminals are disconnected from each other to set the energizing circuit in a non-energized state. Thereafter, the first and second holders 20A, 20B are pulled out from the corresponding openings to open the openings.

As described above, the first and second holders 20A, 20B are supported in a floating state on the underside surface of the cover main body 10 to be movable substantially perpendicular to the connecting direction CD (e.g. movable in a direction of the plane of the cover main body 10 or in all directions with respect to the cover main body 10). Thus, the first and second holders 20A, 20B can be fit into the corresponding openings while being individually centered as the cover main body 10 is attached to the shield case. In this way, the seal rings 25 can be mounted while being squeezed uniformly over substantially the entire peripheries between the first and second holders 20A, 20B and the inner peripheral surfaces of the openings. As a result, a high sealing ability is ensured for the openings.

Further, the floating structure is such that the insertion holes 13 are formed in the cover main body 10, whereas the insert nuts 26 to be fitted in the insertion holes 13 with a clearance are provided on the holders 20A, 20B and the screws 15 are engaged threadedly with the respective nuts 26 via the washers 16. The high working accuracy that is necessary in the case of providing knock pins for centering is not required here, and the seal cover can be produced at low cost.

The restricting holes 17, 18 are provided at the opposite sides of each insertion hole 13, and the pins 27, 28 projecting from the holders 20A, 20B are inserted respectively into the restricting holes 17, 18 as the nuts 26 projecting from the holders 20A, 20B are inserted into the insertion holes 13 with a clearance. Thus, the holders 20A, 20B are prevented from rotating about the insertion holes 13. Therefore, the holders 20A, 20B are prevented from rotating as the screws 15 are screwed into the insert nuts 26. Hence, the screws 15 can be screwed efficiently.

Further, diameters of the pins 27, 28 (restricting holes 17, 18) and distances thereof from the nuts 26 (insertion holes 13) differ. Thus, the holders 20A, 20B cannot be mounted in a wrong posture rotated by 180° from the proper posture.

The invention is not limited to the above described embodiment. For example, the following embodiments also are included in the scope of the invention.

Although the washer that is a member separate from the screw is used as a retaining means when the seal ring holder is retained and supported in the floating state with respect to the cover main body in the above embodiment, a screw with a washer may be used.

Besides that illustrated in the above embodiment, another structure such as a structure in which, for example, a shaft stands on the seal ring holder and is inserted into the insertion hole of the cover main body with a clearance and a C-ring is fit on the projecting end of the shaft as the retaining means may be adopted as a means for floatably supporting the seal ring holder.

The restricting holes provided to prevent the rotation and erroneous mounting of the seal ring holding members may be recesses instead of being through holes.

Only one restricting hole may be provided lateral to the insertion hole.

Although two work holes are formed in the shield case in the above embodiment, the present invention is similarly applicable also in the case where one, three or more openings are formed.

Although the openings are formed in the horizontal upper surface of the shield case in the above embodiment, the present invention is similarly applicable also for a seal cover used when openings are formed in a vertical side surface or an oblique surface of a shield case.

The present invention is also applicable to in-vehicle electric devices including no interlock mechanism.

The cover main body is not limited to a pressed part of a metal plate as described in the above embodiment and may be a die-cast product formed such as by aluminum die casting.

Although the seal ring holding member supporting the interlock connector itself particularly is provided in the floating state on the underside surface of the cover main body in the above embodiment, it may be fixedly provided on the underside surface of the cover main body and such an embodiment is also included in the technical scope of the present invention.

What is claimed is:

1. A seal cover for in-vehicle electric device to be removably attached to close an opening in a case that houses an in-vehicle electric device, comprising:

a cover main body with an outer periphery shaped to cover the opening of the case and to be attached to a surface of the case, the cover main body including opposed top and underside surfaces, and at least one insertion hole penetrating the cover main body between the top and underside surfaces, the at least one insertion hole having an inner surface and a first diameter;

at least one seal ring holder with an outer periphery smaller than the outer periphery of the cover main body, the at least one seal ring holder formed with opposite top and bottom surfaces and at least one shaft projecting from the top surface, the at least one shaft having an outer surface defining a second diameter sufficiently smaller than the first diameter, at least one seal ring mounted around the outer periphery of the at least one seal ring holder, the at least one seal ring holder configured to be mounted to the cover main body with the at least one shaft penetrating the at least one insertion hole and a clearance formed between the outer surface of the at least one shaft and the inner surface of the at least one insertion hole to allow lateral movement of the shaft within the at least one insertion hole, and the at least one seal ring holder with the seal ring mounted thereon configured to be partially inserted into the opening of the case with the seal ring bearing against at least a portion of an inner peripheral surface of the case;

at least one retaining means engaged with the cover main body and the shaft for retaining the shaft;

at least one pin provided on one of the seal ring holder and the cover main body and at least one respective restricting hole provided on the other of the seal ring holder and the cover main body, and a clearance provided between the pin and the restricting hole, the at least one pin and the at least one restricting hole preventing erroneous mounting of the seal ring holder on the cover main body or a rotational displacement of the seal ring holder with respect to the cover main body, wherein a clearance is provided between the pin and the restricting hole, the clearance between the at least one pin and the at least one restricting hole is smaller than the clearance between the shaft and the insertion hole.

2. The seal cover of claim 1, wherein the retaining means for retaining the shaft is engaged with an edge of the insertion hole near a projecting end of the shaft.

3. The seal cover of claim 2, wherein the shaft comprises a nut perforated with a screw hole in the projecting end, the nut projecting from the surface of the seal ring holder facing the underside surface of the cover main body and being insertable into the insertion hole with the clearance.

4. The seal cover of claim 3, wherein a screw is engaged threadedly with the screw hole of the nut.

5. The seal cover of claim 4, wherein the retaining means for retaining the shaft is provided near a head of the screw.

6. The seal cover of claim 1, wherein at least one restricting hole is perforated on the underside surface of the cover main body at a position lateral to the insertion hole, and at least one projection is formed on the surface of the seal ring holder facing the underside surface of the cover main body and is fit into the restricting hole with a clearance as the shaft is inserted into the insertion hole.

7. A seal cover for in-vehicle electric device to be removably attached to close an opening in a case that houses an in-vehicle electric device, comprising:

a cover main body with an outer periphery shaped to cover the opening of the case and to be attached to a surface of the case, the cover main body including opposed top and underside surfaces, and at least one insertion hole penetrating the cover main body between the top and underside surfaces, the at least one insertion hole having an inner surface and a first diameter;

at least one seal ring holder with an outer periphery smaller than the outer periphery of the cover main body, the at least one seal ring holder formed with opposite top and bottom surfaces and at least one shaft projecting from the top surface, the at least one shaft having an outer surface defining a second diameter sufficiently smaller than the first diameter, at least one seal ring mounted around the outer periphery of the at least one seal ring holder, the at least one seal ring holder configured to be mounted to the cover main body with the at least one shaft penetrating the at least one insertion hole and a clearance formed between the outer surface of the at least one shaft and the inner surface of the at least one insertion hole to allow lateral movement of the shaft within the at least one insertion hole, and the at least one seal ring holder with the seal ring mounted thereon configured to be partially inserted into the opening of the case with the seal ring bearing against at least a portion of an inner peripheral surface of the case;

at least one interlock connector projecting from the seal ring holder and being connectable to a waiting connector of the electric device and setting an electric member of the electric device in a specified electric state upon being connected to or separated from the waiting connector, wherein the interlock connector is mounted on the seal ring holder to be movable in a direction at an angle to a connecting direction to the waiting connector; and at least one retaining means engaged with the cover main body and the shaft for retaining the shaft.

* * * * *